United States Patent [19]

Mogi

[11] Patent Number: 4,555,172

[45] Date of Patent: Nov. 26, 1985

[54] DEVELOPING APPARATUS

[75] Inventor: Michio Mogi, Tokyo, Japan

[73] Assignee: Konishiroku Photo Industry Co., Ltd., Tokyo, Japan

[21] Appl. No.: 396,285

[22] Filed: Jul. 8, 1982

[30] Foreign Application Priority Data

Jul. 10, 1981 [JP] Japan ..... 56-107051
Jul. 18, 1981 [JP] Japan ..... 56-112814
Jul. 20, 1981 [JP] Japan ..... 56-114126

[51] Int. Cl.[4] ..... G03G 15/09

[52] U.S. Cl. ..... 355/3 DD; 118/653; 118/658

[58] Field of Search ..... 355/3 DD, 15; 118/652, 118/653, 657, 658, 203; 15/256.51

[56] References Cited

U.S. PATENT DOCUMENTS 3,587,521 6/1971 Rubenstein et al. ..... 118/658 X
3,626,898 12/1971 Gawron ..... 118/658
3,822,139 7/1974 Westdale ..... 118/658 X
3,828,730 8/1974 Yamashita et al. ..... 118/658
4,373,468 2/1983 Sada et al. ..... 118/658
4,373,798 2/1983 Tsukada et al. ..... 118/658 X

FOREIGN PATENT DOCUMENTS 0143239 11/1979 Japan ..... 355/3 DD

*Primary Examiner*—A. T. Grimley
*Assistant Examiner*—J. Pendegrass
*Attorney, Agent, or Firm*—James E. Nilles

[57] ABSTRACT

A developing apparatus equipped with a sleeve and a scraper member to scrape off the developer from the circumferential surface of the sleeve, wherein the scraper member is normally urged resiliently in the direction which considerably separates it from the circumferential surface of the sleeve, and when there is developer on the scraper member the tip of the scraper member comes close to the circumferential surface of the sleeve. A gap is defined in a limited width between the sleeve and a restriction member for restricting the flow rate of the developer. The gap can be non-uniformly changed along the axial direction of the sleeve.

17 Claims, 17 Drawing Figures

DEVELOPING APPARATUS

BACKGROUND OF THE INVENTION

1. Field of the Invention

This invention relates to a developing apparatus for use in an electrostatic recording apparatus such as an electrophotographic reproducing machine.

2. Description of the Prior Art

As is known in the art, a conventional toner developing apparatus has a construction such as shown in FIG. 1. The toner developing apparatus includes a box which stores therein a developer T such as one-component developer or two-component developer. A rotary sleeve 3 is placed inside the box 1 in the proximity of the circumferential surface of a photosensitive drum 2, and a plurality of permanent magnets 4 are positioned inside the rotary sleeve 3 with their poles directed in the radial direction of the rotary sleeve 3. The tip 5*a* of a scraper plate 5 extending in the tangential direction is brought into linear contact with the outer circumferential surface of the rotary sleeve 3 so that the developer on the circumferential surface is scraped off by the scraper plate 5 and frictionally charged by agitation blades 6.

Since high speed development has been required recently, the latest models of toner developing apparatuses increase the rotational speed of the rotary sleeve 3 and use a developer having a high electric insulating property, especially those having a spherical carrier. In such high speed developing apparatuses, the thickness of the developer deposited on the circumferential surface of the rotary sleeve 3 is as thin as from 0.5 to 1.5 mm, so if the rotary sleeve 3 has a smooth surface transfer of the developer is partially cut off, or a so-called "shortage" of developer occurs so that a part of the electrostatic latent image can not be developed. Accordingly, in developing apparatuses which use a thin developer layer, the circumferential surface of the rotary sleeve 3 is sometimes intentionally roughened to improve the transfer power between the circumferential surface and the developer. With this construction, however, the scraper plate 5 is likely to come into linear contact with the circumferential surface of the rotary sleeve 3 even if it is disposed in such a manner that it does not come into contact with the surface of the rotary sleeve 3 but scrapes off the developer therefrom. In consequence, the roughened surface on the rotary sleeve 3 is rapidly worn out by the tip 5*a* of the scraper plate and the developer can not be scraped off partially from the rotary sleeve 3. Needless to say, the scraper plate 5 itself is also worn. In this case, the rotary sleeve 3 for developing itself must be replaced.

As described above, in a dry developing apparatus generally including a plurality of fixed magnets disposed in an arc and a rotary sleeve of a non-magnetic material adapted to rotate around the outer circumference of the fixed magnets, the image receptor for forming an image, i.e. the photosensitive drum, is in most cases adapted to rotate clockwise for convenience in the arrangement of an image forming processing portion and for smooth transfer of the image, if the apparatus employs means for transferring a developer consisting of a carrier and a toner or a one-component developer integrating the carrier with the toner. On the other hand, the rotary sleeve for transferring the developer is rotated from below to above, or clockwise, in the developing apparatus in order to transfer a sufficient quantity of developer from the developer reservoir at high speed without scattering. Accordingly, in the developing process, the photosensitive drum and the rotary sleeve unavoidably move in opposite directions and the developer impinges against the surface of the photosensitive drum too strongly. This problem can be prevented by moving both the rotary sleeve and the photosensitive drum in the same direction in the developing portion. In order to rotate the rotary sleeve counter-clockwise and to transfer the developer to the developing portion sufficiently smoothly, however, fixed magnets must be continuously disposed inside the rotary sleeve. Since no gap exists in the magnetic portion in this case, it becomes extremely difficult to replace the developer. Because of this problem, the conventional system rotates the photosensitive drum and the rotary sleeve for developing in opposite directions and does not dispose the magnets at the upper scraping portion of the developer to facilitate the replacement of the developer. In developing with this system, a large strong magnet is used for the main developing magnet portion. In this case, magnetic iron powder of amorphous state is used as the carrier and the magnetic force generates the form of a high ear $L_1$ via the magnetic iron powder as shown in FIG. 2. In this case, the gap between the surface A of the photosensitive drum and the rotary sleeve is from 4 to 5 mm and the developer does not scatter by the surface A of the photosensitive drum because sufficient magnetic attraction acts upon the carrier at the tip of the ear. However, the magnetic iron powder of amorphous state has the problem of low durability and the developer must be replaced frequently.

In recent years, improvements in the developer, especially the carrier, have made remarkable progress and a spherical carrier having an insulating agent such as resin coated on the outer circumference of the carrier has been developed. The spherical carrier has durability of about 5 times that of the conventional magnetic iron powder of amorphous state and is effective in reducing the number of times the developer must be replaced. Contrary to its high durability, however, the spherical carrier is somewhat difficult to transfer. This is because the surface of the carrier is coated with the insulating material and the carrier has low magnetic binding force and insufficient attraction. In addition, since the carrier is spherical, the contact surface between the carrier particles is small and the force of attachment to the rotary sleeve for developing and the transfer power are low. To obtain a satisfactory picture image, the gap between the surface of the developing cylinder and the surface of the photosensitive drum is most preferably from 0.5 to 15 mm. If the ear for development of the carrier is formed as high as the ear of the carrier of amorphous state especially in the developing portion where it comes into contact with the surface of the photosensitive drum, the carrier is thrown off against the attraction of the magnetic force by the turning force of the surface of the photosensitive drum and drops in large quantities.

Furthermore, there is some non-uniformity in the sensitivity of the photosensitive member on the surface of the photosensitive drum. This non-uniformity of the sensitivity generates non-uniformity of the charge potential of the photosensitive drum in the axial direction and results in non-uniformity of the image density. Two adjusting means have conventionally been employed to prevent this non-uniformity of the sensitivity of the photosensitive member from resulting in non-uniformity of the density. One of them moves a charging were so as to change the gap between the wire and the surface of the photosensitive drum and make the charge potential uniform. As shown in FIG. 3(*a*), for example, when the charge potential E of the photosensitive drum uniformly increases (or decreases) with the distance x from one end of the drum, the gap between the charging wire and the surface of the photosensitive drum is adjusted to increase (or decrease) with the distance x, thereby making the charge potential uniform and eliminating the non-uniformity of the density. However, it is structurally difficult to modify the charging wire in the form of a bent line, and adjustment is not possible for a photosensitive drum showing a charge potential as shown in FIGS. 3(*b*) and 3(*c*). The other adjustment means adjusts the light distribution to the photosensitive drum. In the case of a photosensitive drum showing the characteristics shown in FIG. 3(*b*), for example, the amount of light at the ends of the photosensitive drum is increased compared with the amount of light at the center. Though this adjustment is effective for low density portions, it is completely ineffective for so-called "solid" portions which are not affected by the amount of light.

SUMMARY OF THE INVENTION

To eliminate the problem of the service life of the conventional scraper plate, the present invention proposes a construction in which a resilient restoration moment is applied to the scraper plate and the tip of the scraper plate is brought suitably close to the circumferential surface of the sleeve by the weight of the developer on the scraper plate.

In a magnetic developing device is a dry electrophotographic process or in a dry electrostatic printing process, another object of the present invention is to provide a magnetic portion for forming a magnetic brush, consisting of a main developing magnet portion and an auxiliary magnet portion, wherein the auxiliary magnet portion is formed separately from the main magnet portion at a position where the magnetic force of the main magnetic portion acts so as to form a dense and low ear of developer by the lines of magnetic force of both the main and auxiliary magnetic portions.

It is another object of the present invention to provide a developing apparatus having a construction in which a greater number of auxiliary magnets for transferring the developer and a main magnet for forming the ear of developer are disposed inside the rotary sleeve for developing than the number of magnets in the conventional apparatus; the width of the main magnet for forming the ear of developer is reduced; the auxiliary magnets formed separately from the main magnet are disposed close to and in front and behind the main magnet at positions where their magnetic force is associated with that of the main magnet in order to reduce the height of the ear for developing, to generate sufficient magnetic force by the main and auxiliary magnets, to increase the density of the lower layer of carrier in the developing portion so that the magnetic force of the auxiliary magnets acts upon it sufficiently with the magnetic force of the main magnet being the principal force, to make the magnetic force at the back of the developing position stronger than the magnetic force of the main magnet, thereby forming the ear of developer sufficiently wide to provide the developing effect and maintain sufficient transfer power for the developer.

It is still another object of the present invention to provide an extremely effective means for forming an ear for developing having a high density even for a spherical carrier, for improving the mutual attraction between the rotary sleeve and the developer and for thus improving the transfer power of the developer.

It is still another object of the present invention to eliminate the non-uniformity of the density resulting from the non-uniformity of the sensitivity of the photosensitive member by means of a magnetic brush developing apparatus, in particular by a magnetic brush developing apparatus having a construction in which a gap having a limited width between the developing sleeve and a restriction plate disposed confronting the developing sleeve for restricting the flow rate of the developer can be non-uniformity changed along the axial direction of the developing sleeve to increase the amount of developer transferred to developing portions having a low charge potential and eliminating the non-uniformity of the density.

These and other objects and features of the present invention will become more apparent from the following detailed description taken in conjunction with the accompanying drawings.

DESCRIPTION OF THE PREFERRED EMBODIMENTS

Figure 4:
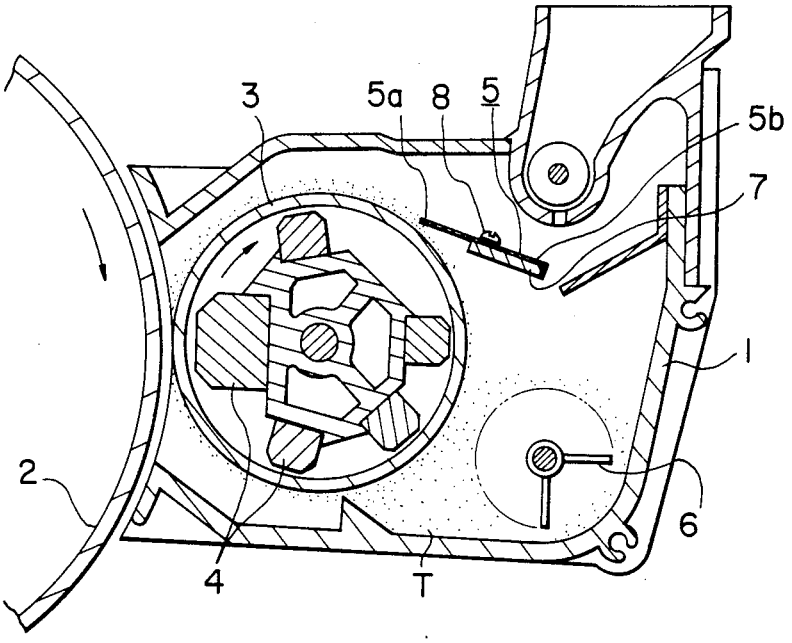
FIG. 4 is a sectional view of the toner developing apparatus in accordance with the present invention.

As shown in FIG. 4, the scraper plate 5 as a scraper member in accordance with the present invention is made of a thin flexible plate such as Mylar paper. A mounting plate 7 extended in the longitudinal direction is disposed inside the box 1 and the base 5*b* of the scraper plate 5 is fixed to the mounting plate 7 by mounting screws 8 or the like. The intermediate portion 5*c* of the scraper plate 5 extending from the mounting plate 7 extends in the circumferential direction of the rotary sleeve 3 but its tip 5*a* is spaced considerably away from the circumferential surface 3*a* of the rotary sleeve 3 by a predetermined distance in the natural state, as shown enlarged in FIG. 5.

Figure 5:
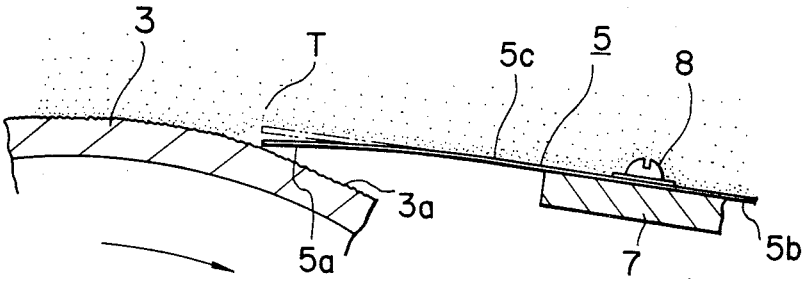
FIG. 5 is an enlarged view of the principal portions of the apparatus shown in FIG. 4.

When there is developer on the intermediate portion 5c of the scraper plate 5 from the rotation of the rotary sleeve 3, the intermediate portion 5c is deflected by the weight of the developer as shown by the solid line in FIG. 5 and the tip 5a of the scraper plate 5 comes suitably close to the circumferential surface 3a of the rotary sleeve 3. As a result, most of the developer on the rotary sleeve 3 is transferred onto the scraper plate 5 and then drops onto the agitation vane 6 so that re-mixing and frictional charging can be carried out effectively.

Figure 5A:
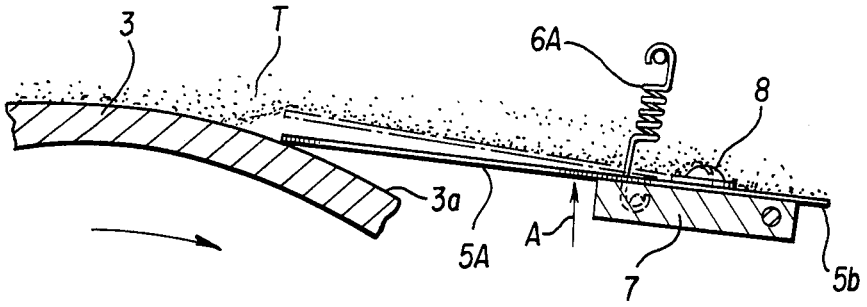
FIG. 5A is another embodiment of scraper means shown in FIG. 5.

Though the abovementioned embodiment uses as a flexible plate the scraper plate, the present invention is not limited to this construction in particular. For example, as FIG. 5A shows, a scraper plate 5A itself may be made of a rigid body and be urged in one direction (see arrow A) by a spring 6A.

As is obvious from the above explanation, the present invention makes it possible to prevent abrasion of the roughened surface of the rotary sleeve 3 and abrasion of the tip of the scraper plate, providing a toner developing apparatus having an extended service life. The present invention is effective for a high speed toner developing apparatus. Though the tip of the scraper plate wears in the course of use of the apparatus over an extended period of time, the developing apparatus can be used again because the tip can be rapidly replaced.

Figure 6:
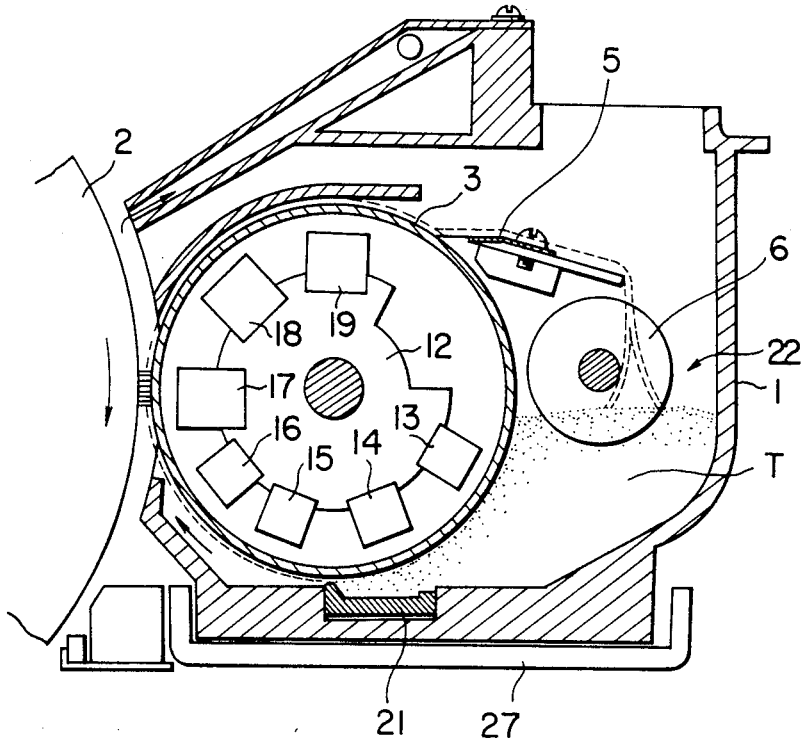
FIG. 6 is a sectional view useful for explaining another embodiment of the present invention.

FIG. 6 illustrates another embodiment of the present invention. Reference numeral 1 represents a non-magnetic frame of the main body of the developing apparatus and reference numeral 12 represents a non-magnetic shaft that is fixed and supported inside the frame. As shown in the drawing, magnets 13 through 19 are radially arranged on the shaft 12. The sleeve or cylinder 3 is made of a non-magnetic material and can rotate around the outer circumference of the magnets 13–19. Both ends of the sleeve or cylinder 3 are supported by the frame. Reference numeral 21 represents a restriction member for restricting the developer T placed in a developer reservoir 22 and transferring a suitable quantity of developer to the developing portion. Reference numeral 5 represents the scraper plate for scraping the developer T that has passed through the developing portion off from the surface of the cylinder 3, and reference numeral 6 represents a developer agitation member that is disposed inside the developer reservoir 22 and can be driven to rotate. Reference numeral 2 represents a photosensitive drum and reference numeral 27 represents a support bed supported so that the frame 1 of the developing apparatus can be slid in the axial direction.

The operation of the developing apparatus having the abovementioned construction will now be described.

As shown in FIG. 6, an electrostatic latent image formed on the photosensitive drum of the electrophotographic process is developed in the developing apparatus. The developer T is agitated by the agitation member inside the developer reservoir 22 and the developer T close to the surface of the cylinder 3 is attracted by magnets 13 and 14. While being attracted to the surface of the cylinder 3, the developer is restricted to a predetermined quantity by the developer restricting member 21 and transferred to the developing portion on the cylinder 3 while being attracted by the transfer magnet 15.

Figure 1:
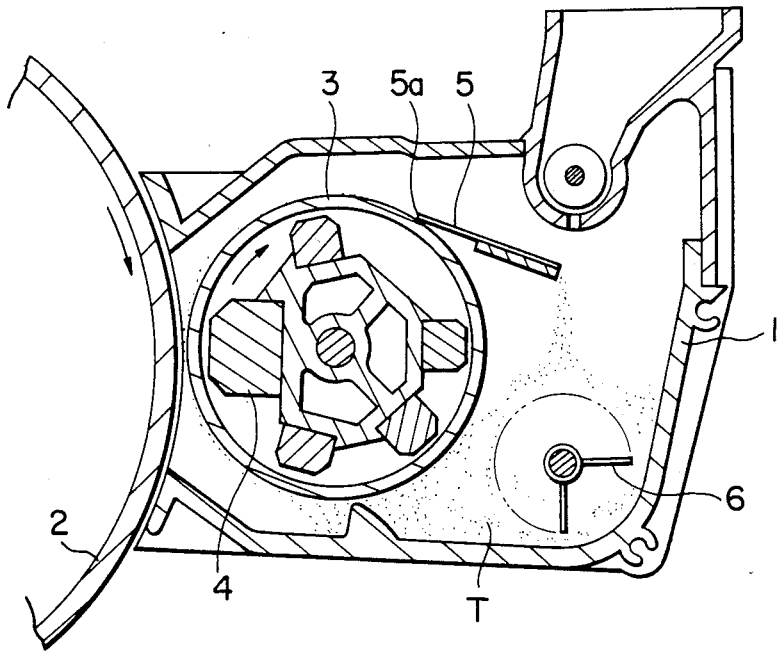
FIG. 1 PRIOR ART
FIG. 1 is a sectional view of the conventional toner developing apparatus.
Figure 2:
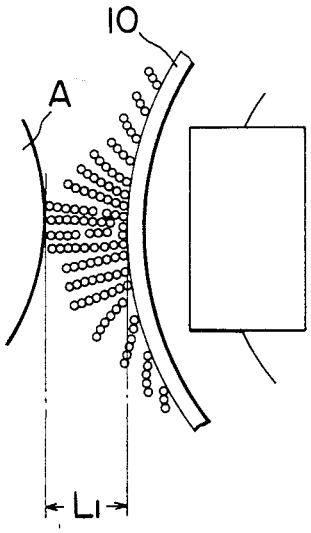
FIG. 2 PRIOR ART
FIG. 2 is a schematic view useful for explaining the state of the ear in the conventional developing portion.
Figure 7:
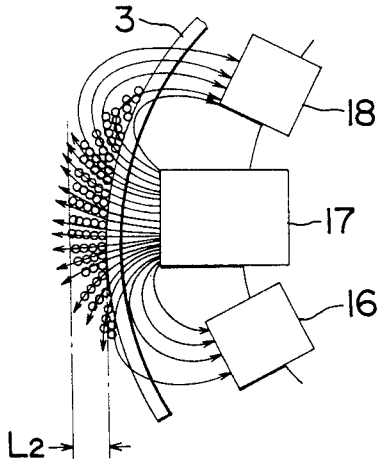
FIG. 7 is a schematic view showing the state of the ear in the apparatus of FIG. 6.

Next, as shown in FIG. 7, while being attracted by the auxiliary developing magnet 16, the developer T reaches the developing portion which is affected by the magnetic force of the main developing magnet 17. Separate auxiliary magnets 16 and 18 are disposed above and below the main developing magnet 17 close to one another so as to generate lines of magnetic force (see FIG. 7) for forming the ear for developing by the interaction of the magnetic forces of these magnets 16, 17 and 18. The angle between the main developing magnet 17 and the auxiliary magnet 18 is set to 50° and the angle between the main magnet 17 and the auxiliary magnet 16 is set to 35°. Accordingly, the magnetic force of the main developing magnet 17 is weaker than that of the conventional main magnet (see FIG. 2) and it is narrower. For this reason, though the earing force is low, a magnetic force having a high density in the perpendicular direction is generated in the developing portion and the developer T is shaped in an ear with a low height but a high density in the radial direction as it is formed by a high density magnetic force in the radial direction effected by the main magnet 17 and the auxiliary magnets 16, 18 above and below the developing portion. In this case, the distance between the photosensitive drum and the surface of the cylinder 3 is preferably about 0.5 mm to 1.5 mm.

In the developing system using an insulating spherical carrier having a resin coating on the surface, the spherical carrier of the developer to be used in the developing apparatus of the present invention is densely formed and the ear is low so that the developer can be sequentially transferred while the spherical carrier can be sufficiently held on the cylinder surface. After development is completed, the developer is held by the auxiliary developing magnet 18 having a higher magnetic force than the main developing magnet 17. The developer using this spherical carrier, that would otherwise scatter easily, is sufficiently attracted and transferred, conveyed by the transfer magnet 19, scraped off from the cylinder 3 by the scraper plate 5, and thereafter drops into the developer reservoir 22.

Figure 8:
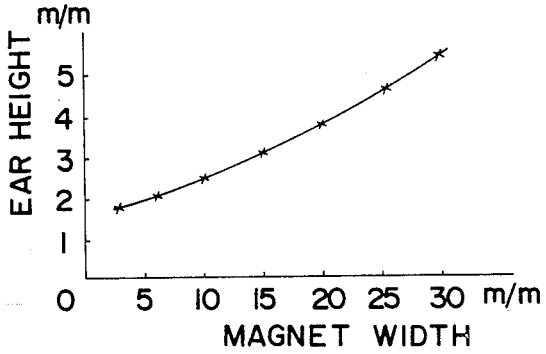
FIG. 8 is a diagram showing the relation between the magnet width and the ear height.
Figure 3A:
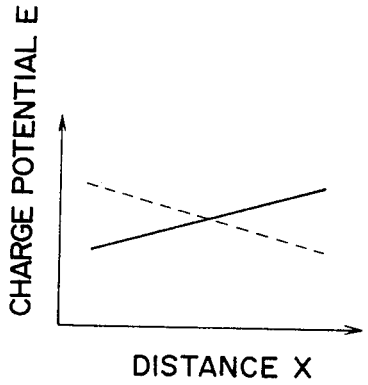
FIGS. 3(*a*) through 3(*c*) are diagrams showing examples of the charge potential of a photosensitive drum.
Figure 3B:
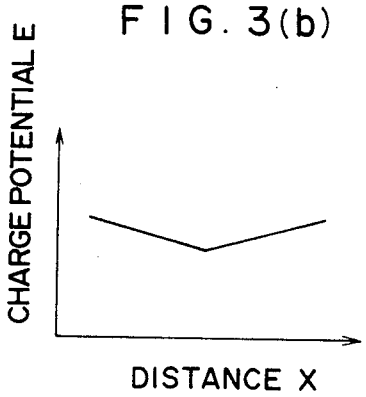
Figure 3C:
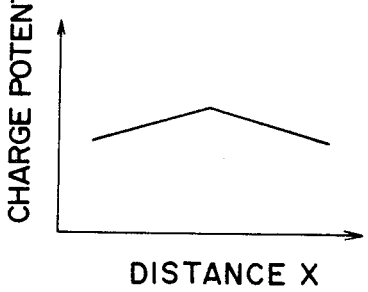

FIG. 8 illustrates the relation between the magnet width and the ear height. It can be seen that the greater the magnet width, the greater the ear height and the rougher the tip of the ear. In this case, the quantity of developer fed is kept constant. It has been found that the width of the main transfer magnet is preferably from 8 to 15 mm, and most preferably about 10 mm. When the ear height is from 0.5 to 15 mm, the force for retaining the spherical carrier and the conditions of the ear in the developing portion are especially satisfactory. When the main developing magnet 17, the auxiliary developing magnet 16 disposed below it and the auxiliary developing magnet 18 disposed above it are set to 800 Gauss, 700 Gauss and 830 Gauss, respectively, the developer consisting of the spherical carrier can be densely formed in the developing portion and transferred without scattering. When the transfer and developing magnets have at least five magnetic positions after the quantity of the developer to be transferred is restricted, effective picture quality and transfer can be realized. In this case, the outer diameter of the rotary cylinder 3 for developing is set to 60 mm and the rotational speed of the cylinder is set to 210 rpm. Though the present invention is specifically effective for transferring a developer using an insulating spherical carrier and forming the ear for developing, the present invention can naturally be applied to the conventional developer using odd shaped magnetic iron powder.

In the present invention described above, the main developing magnet has a reduced width and the auxiliary developing magnets are disposed separately above and below the main magnet in the proximity thereof where they can form the developer into an ear. According to this arrangement, a low height and high dense ear of developer can be formed and the developer can also be sufficiently transferred. Thus, the developing apparatus can smoothly transfer a developer using a spherical carrier having an especially high fluidity to the developing portion and provide sufficient developing effects by means of the low ear of developer. The developing apparatus of the present invention is extremely effective when applied to a high speed developing apparatus.

Figure 9:
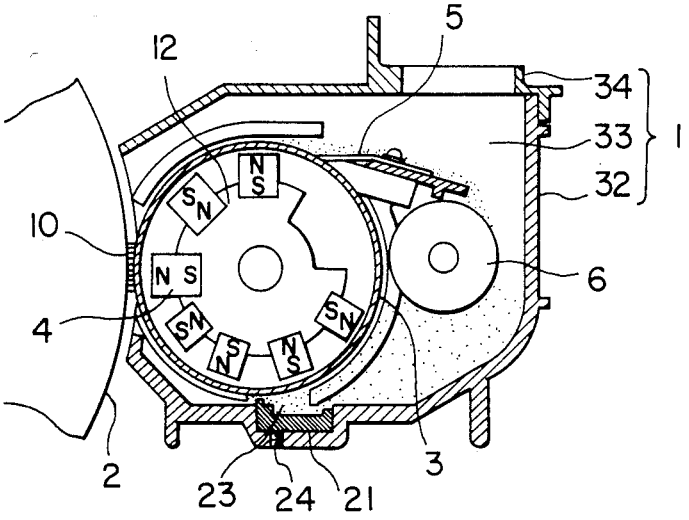
FIG. 9 is a sectional view of the brush developing apparatus in accordance with the present invention.

FIG. 9 is a sectional view showing still another embodiment of the present invention. The developer container 1 for storing the developer consists of a main member 32, an end member 33 and an upper member 34 and has openings at the portion confronting the photosensitive drum 2 and at the upper portion. The developing sleeve 3 is disposed inside this container 1. The developing sleeve 3 is made of an electrically conductive but non-magnetic material such as brass or aluminum and is rotated clockwise in FIG. 9 by a motor (not shown). Reference numeral 12 represents a core disposed inside the developing sleeve 3. A plurality of permanent magnets 4 are fixed to the core 12 with the polarities shown in FIG. 9, for example. Developer, which has been frictionally charged by the agitation blade 6, is attracted by the permanent magnets 4 to the surface of the developing sleeve 3 and forms a magnetic brush 10 that comes into sliding contact with the photosensitive surface of the photosensitive drum 2.

Figure 11:
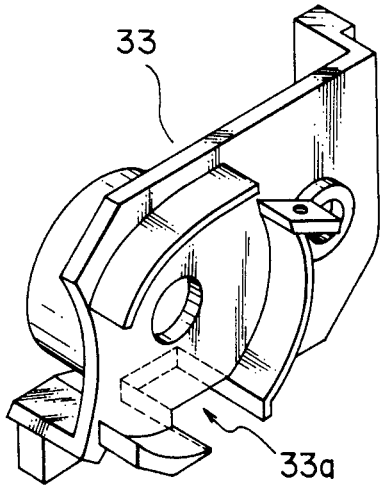
FIG. 11 is a perspective view of the end member of a developer container.
Figure 10:
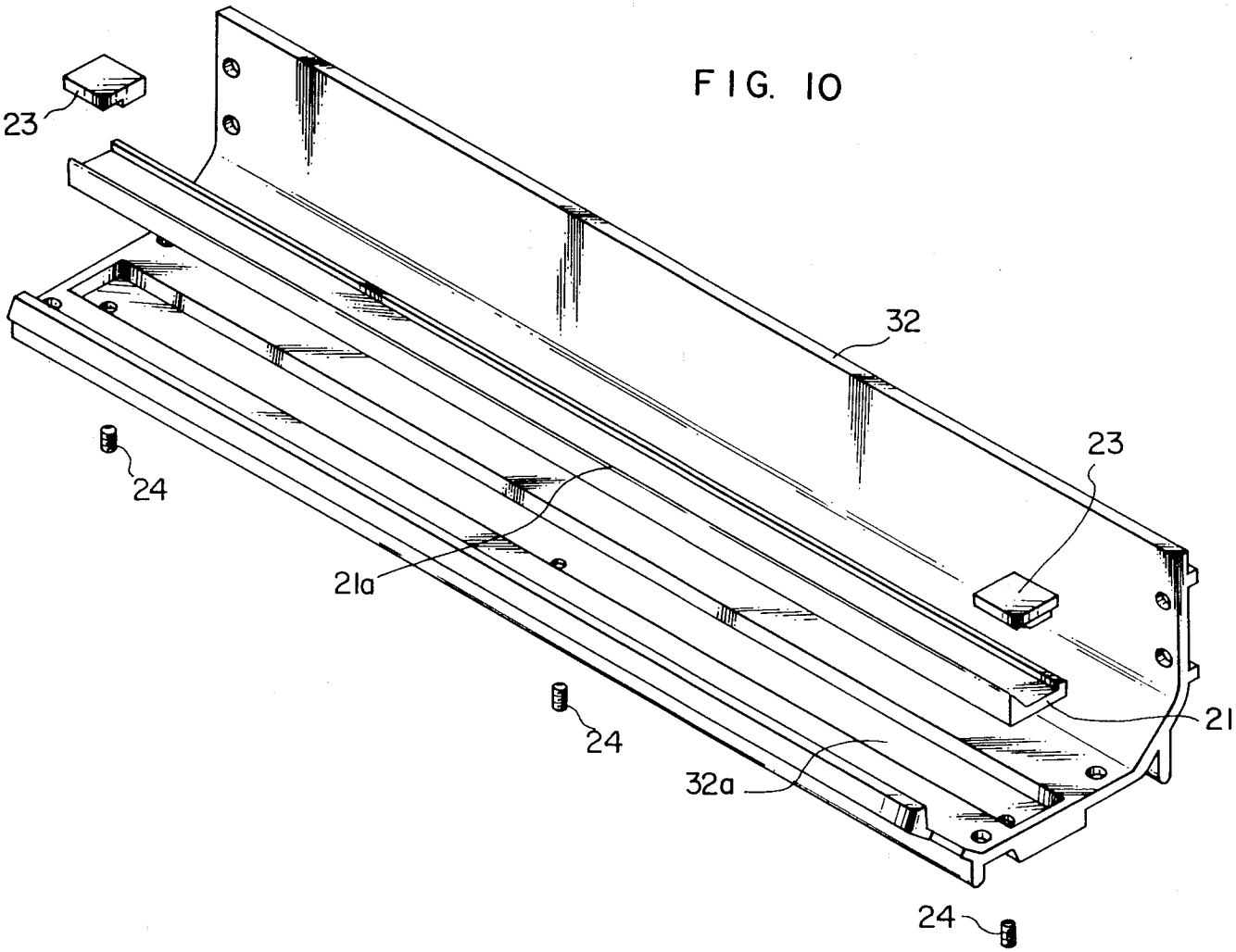
FIG. 10 is an exploded perspective view of the principal portions of the apparatus shown in FIG. 9.

Reference numeral 21 represents a restriction plate for restricting the flow rate of the developer of the magnetic brush 10. The plate 21 is disposed confronting the developing sleeve 3. Reference numeral 5 represents the scraper for scraping the developer off from the developing sleeve 3 after developing. As shown also in the perspective view of FIG. 10, the restriction plate 21 is contained in a recess 32*a* of the main member 32 of the developer container 1. The upper surface at both its ends is pushed from above by support members 23 made of relatively rigid rubber and the lower surfaces at its both ends and at its center come into contact with the tips of support screws 24 mating with female portions of the recesses 32*a*. The restriction plate 21 for restricting the flow rate of the developer is subjected to predetermined plastic deformation before assembly so that the ridgeline of a relatively sharp edge portion of the restriction plate 21 projects downward in the natural state. A recess 33*a* for holding the support member 23 in place is defined on the lower surface of the end member 33 of the developer container 1 as shown in FIG. 11. In FIGS. 9 and 11, the end member in the foreground is not shown, but it has a shape analogous to that of the end member 33 of FIG. 11, and a recess for holding the support member 23 is likewise formed on its lower surface.

Figure 12:
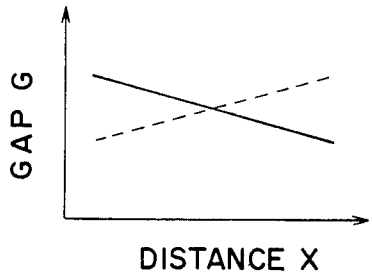
FIGS. 12(*a*) through 12(*c*) are diagrams useful for explaining the adjustment of the gap between the developing sleeve and a restriction plate for restricting the flow rate of the developer.
Figure 12:
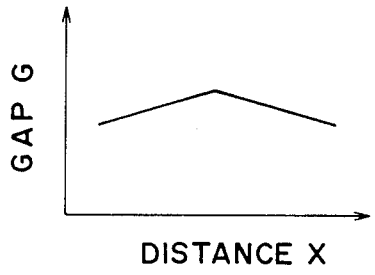
Figure 12:
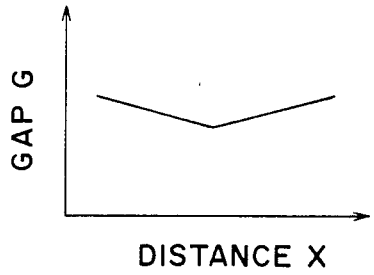

In the embodiment having the abovementioned construction, the gap between the developing sleeve 3 and the restriction plate 21 for restricting the flow rate of the developer can be non-uniformly changed by adjusting the amount the three support screws 24 are screwed in. In this embodiment, the gap between the tips of the sleeve 3 and restriction plate 21 is set as narrow as about 0.5 to 1.5 mm. When the support screws 24 are screwed in, the restriction plate 21 in the proximity of the screws moves towards the developing sleeve 3 by elastic deformation of the support member 23 or elastic deformation of the restriction plate 21 itself. When the screws are screwed back, the restriction plate 21 for restricting the flow rate of the developer moves away from the developing sleeve 3. In this manner, the gap G between the developing sleeve 3 and the restriction plate 21 for restricting the flow rate of the developer can be changed by adjusting the amount the screws 24 are screwed in, as shown in FIGS. 12(*a*) through 12(*c*). The transfer quantity of the developer increases at portions where the gap G is great and decreases at portions where the gap G is small. Accordingly, a picture image free from non-uniformity in the density can be obtained by increasing the quantity of the developer transferred for the portions of the photosensitive drum 2 having a low charge potential, or, more concretely, by adjusting the gap G in the manner shown in FIGS. 12(*a*) through 12(*c*) for a photosensitive drum 2 exhibiting the characteristics shown in the same drawings.

In the above explanation, the ridgeline of the edge portion of the restriction plate 21 for restricting the flow rate of the developer is plastically deformed to project downward, but this shape can be also obtained by a cutting process. Though this embodiment employs the construction in which the restriction plate 21 is displaced by means of the support member 23 and the support screws 24, the construction can also be accomplished by use of adjusting means for moving the restriction plate 21 while restricting its both ends and center such as means for turnably fitting the tips of the support screws 24 to the restriction plate 21 for restricting the flow rate of the developer. This arrangement eliminates the production step of deforming the restriction plate 21 in advance before assembling it into the developing apparatus. Furthermore, in the abovementioned embodiment, the deforming force is applied to the restriction plate 21 at three positions, but it may be applied at two or fewer positions or at four or more positions. In short, any adjusting means may be used as long as it can deform and displace the restriction plate 21 for restricting the flow rate of the developer.

As described in the foregoing, the present invention makes it possible to non-uniformly change the gap between the developing sleeve and the restriction plate along the axial direction of the sleeve so that the quantity of the developer transferred to the portions of the photo-sensitive drum having a low charge potential can be increased and hence, non-uniformity of the density can be eliminated.

What is claimed is:

1. In a developing apparatus equipped with a sleeve placed inside a casing for storing developer and transferring the developer by means of the circumferential surface thereof and a scraper member positioned confronting the circumferential surface of said sleeve to scrape off the developer from the circumferential surface of said sleeve, the improvement wherein said scraper member is movable and is normally urged resiliently in the direction away from said sleeve to a first position which separates it a predetermined distance from the circumferential surface of said sleeve, and when there is developer on said scraper member the weight thereof causes the tip of said scraper member to move to another position closer to the circumferential surface of said sleeve.

2. The developing apparatus as defined in claim 1 wherein said sleeve incorporates a plurality of magnets therein.

3. The developing apparatus as defined in claim 2 wherein a gap is defined in a limited width between said sleeve and a restriction member for restricting the flow rate of the developer, said restriction member being disposed upstream of a developing zone so as to confront said sleeve and said gap can be non-uniformly changed along the axial direction of said sleeve.

4. The developing apparatus as defined in claim 2 or 3 wherein said plurality of magnets consist of a main developing magnet portion of a limited width and an auxiliary developing magnet portion for that is formed separately from said main magnet portion at a position in the proximity of the developing zone with said main magnet portion being the center so that the magnetic force of said auxiliary magnet portion is associated with that of said main magnetic portion.

5. The developing apparatus as defined in claim 1 wherein said scraper member is rigid and is urged in the direction away from said sleeve by a spring.

6. A developing apparatus characterized in that a gap of a limited width is defined between a developing sleeve and an elongated flexible restriction member for restricting the flow rate of the developer, said restricting member being adjustably mounted on a developer container and disposed so as to confront said sleeve, and said gap can be non-linearly changed along the axial direction of said developing sleeve by means of adjustment screws mounted on said developer container and engageable with said restriction member.

7. The developing apparatus as defined in claim 6 which includes a scraper member that is normally urged resiliently in the direction in which the tip thereof is considerably separated from the circumferential surface of said sleeve, and when there is the developer on said scraper member the tip of said scraper member comes close to the circumferential surface of said sleeve and scrapes the developer off from the circumferential surface of said sleeve.

8. The developing apparatus as defined in claim 6 wherein said sleeve incorporates therein a plurality of magnets.

9. The developing apparatus as defined in claim 8 wherein said plurality of magnets consist of a main developing magnet portion having a limited width and an auxiliary developing magnet portion formed separately from said main magnet portion at a position in the proximity of the developing position with said main magnet portion having a limited width being the center so that the magnetic force of said auxiliary magnet portion is associated with that of said main magnet portion.

10. In a developing apparatus, in combination: a sleeve which incorporates a plurality of magnets therein and is placed inside a casing for storing developer and transferring the developer by means of the circumferential surface thereof; an adjustably positionable restriction member mounted on said casing which defines a gap of limited width between said sleeve and said restriction member for restricting the flow rate of the developer, said restriction member being disposed upstream of a developing zone so as to confront said sleeve and said gap can be non-uniformly changed along the axial direction of said sleeve; and a scraper member positioned confronting the circumferential surface of said sleeve to scrape off the developer from the circumferential surface of said sleeve, said scraper member being normally urged resiliently in the direction away from said sleeve which thereby separates it from the circumferential surface of said sleeve and when there is developer on said scraper member the tip of said scraper member comes close to the circumferential surface of said sleeve.

11. The developing apparatus as defined in claim 10 wherein said plurality of magnets comprises a main developing magnet portion of a limited width and a plurality auxiliary developing magnet portions formed separately from said main magnet portion, said magnets disposed at a position in the proximity of the developing zone with said main magnet portion being the center so that the magnetic force of said auxiliary magnet portion is associated with that of said main magnetic portion.

12. In a developing apparatus including: a plurality of fixed magnet portions; a moving member for transferring developer moving in the direction opposite to an image receptor disposed on the outer circumference of said moving member; a main developing magnet portion having a limited width and a plurality of auxiliary magnet portions formed separately from said main magnet portion disposed at a position in the proximity of the developing position inside said moving member for transferring the developer with said main magnet portion of a limited width, said main developing magnet being located at the center of said developing position and with said auxiliary magnet portions disposed on an opposite sides said main magnet portion so that the magnetic force of said auxiliary magnetic portion is associated with that of said main magnet portion, the auxiliary magnet portion which is disposed on the side of the main magnet portion in the direction in which said moving member moves being spaced from said main magnet portion by a greater radial distance than the other auxiliary magnet portion; a restriction member and a gap of a limited width defined between said moving member and said restriction member for restricting the flow rate of the developer, said restriction member being disposed so as to confront said moving member and so that said gap can be non-linearly changed along the axial direction of said moving member; and a scraper member that is normally urged resiliently in such a direction that the tip thereof is considerably separated from the circumferential surface of said moving member, and when there is developer on said scraper member the tip of said scraper member comes close to the circumferential surface of said moving member and scrapes the developer off from the circumferential surface of said moving member.

13. A developing apparatus comprising: a developing sleeve; an elongated flexible restriction member; a gap of a limited width defined between said developing sleeve said elongated restriction member for restricting the flow rate of the developer, said restricting member being adjustably mounted on a developer container and disposed so as to confront said sleeve, and so that said gap can be non-linearly changed along the axial direction of said developing sleeve by means of adjustment screws mounted on said developer container and engageable with said restriction member; and a scraper member that is normally urged resiliently in the direction in which the tip thereof is considerably separated from the circumferential surface of said sleeve, and when there is the developer on said scraper member the tip of said scraper member comes close to the circumferential surface of said sleeve and scrapes the developer off from the circumferential surface of said sleeve.

14. The developing apparatus as defined in claim 13, wherein said sleeve incorporates therein a plurality of magnets.

15. The developing apparatus as defined in claim 14 wherein said plurality of magnets consist of a main developing magnet portion having a limited width and an auxiliary developing magnet portion at a position in the proximity of the developing position with said main magnet portion having a limited width being the center so that the magnetic force of said auxiliary magnet portion is associated with that of said main magnet portion.

16. In developing apparatus wherein a gap of limited width is defined between a developing sleeve and a restriction member for restricting the flow rate of developer, said restriction member being disposed so as to confront said sleeve, and said gap being changeable along the axial direction of said developing sleeve, the improvement wherein said restriction member has an adjusting member, and said gap can be adjusted by means of said adjusting member from the outside of the developing apparatus.

17. In a developing apparatus including a plurality of fixed magnet portions and a moving sleeve for transferring developer moving in the direction opposite to an image receptor disposed on the outer circumference thereof, the improvement wherein a main developing magnet portion having a limited width is disposed and a plurality of auxiliary magnet portions formed separately from said main magnet portion are disposed at a position in the proximity of the developing position inside said moving sleeve for transferring the developer with said main magnet portion of a limited width being located at the center of said developing position and with said auxiliary magnet portions disposed on opposite sides of said main magnet portion and sufficiently close thereto so that the magnetic force of said auxiliary magnetic portion is associated with and effects the magnetic force of said main magnet portion, the auxiliary magnet portion which is disposed on the side of the main magnet portion in the direction in which said moving sleeve moves being spaced from said main magnet portion by a greater radial distance than the other auxiliary magnet portion, and wherein a gap of a limited width is defined between said sleeve and a restriction member for restricting the flow rate of the developer, said restriction member being disposed so as to confront said sleeve and so that said gap can be non-linearly changed along the axial direction of said sleeve, and wherein a scraper member that is normally urged resiliently in such a direction that the tip thereof is considerably separated from the circumferential surface of said sleeve, and when there is developer on said scraper member the tip of said scraper member comes close to the circumferential surface of said sleeve and scrapes the developer off from the circumferential surface of said sleeve.

* * * * *